US009890442B1

(12) United States Patent
Nabawy et al.

(10) Patent No.: US 9,890,442 B1
(45) Date of Patent: Feb. 13, 2018

(54) METHOD OF PREPARING A METAL MATRIX NANOCOMPOSITE

(71) Applicant: KING SAUD UNIVERSITY, Riyadh (SA)

(72) Inventors: Ahmed Mohammed Nabawy Nabawy, Riyadh (SA); El-Sayed M. Sherif, Riyadh (SA); Khalil Abdelrazek Khalil, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 15/462,459

(22) Filed: Mar. 17, 2017

(51) Int. Cl.

| | |
|---|---|
| ***C22C 1/02*** | (2006.01) |
| ***C22C 1/10*** | (2006.01) |
| ***C22C 1/04*** | (2006.01) |
| ***B22F 9/04*** | (2006.01) |
| ***C22C 21/00*** | (2006.01) |

(52) U.S. Cl.
CPC ..... *C22C 1/0416* (2013.01); *B22F 9/04* (2013.01); *C22C 1/02* (2013.01); *C22C 1/026* (2013.01); *C22C 1/10* (2013.01); *C22C 1/1036* (2013.01); *C22C 1/1068* (2013.01); *C22C 21/00* (2013.01); *B22F 2009/043* (2013.01); *C22C 2001/1052* (2013.01)

(58) Field of Classification Search
CPC ..... B22F 2202/00; B22F 2202/01; B22F 2202/05; B22F 2202/06; B22F 2202/07; B22F 2202/17; B22F 2998/00; B22F 2998/10; B22F 2999/00
See application file for complete search history.

(56) References Cited

U.S. PATENT DOCUMENTS

| | | | | |
|---|---|---|---|---|
| 9,138,806 | B2 * | 9/2015 | Nabawy | B22F 3/105 |
| 2012/0060648 | A1 * | 3/2012 | Zhao | B22D 1/00 75/10.67 |
| 2013/0152739 | A1 | 6/2013 | Li et al. | |
| 2016/0260530 | A1 * | 9/2016 | Yue | H01F 1/0536 |

FOREIGN PATENT DOCUMENTS

| | | | | |
|---|---|---|---|---|
| CN | 104690270 | A * | 6/2015 | H01F 41/0253 |
| JP | 2000-343202 | A | 12/2000 | |
| WO | WO 2015028065 | A1 * | 3/2015 | B22D 1/00 |

OTHER PUBLICATIONS

C. Suranarayana, "Mechanical alloying and milling," Progress in Materials Science, 46, 2001, pp. 1-184.*

* cited by examiner

*Primary Examiner* — Roy V King
*Assistant Examiner* — Vanessa T Luk
(74) *Attorney, Agent, or Firm* — Richard C. Litman

(57) ABSTRACT

A method for synthesizing a metal matrix nanocomposite (MMNC) is an in-situ synthesis technique for preparing a metal matrix with ceramic reinforcements dispersed homogenously therein. The method includes mixing a base metal matrix material with two or more ceramic-forming elements to form a mixture; blending the mixture; drying the mixture; ball milling the mixture with a plurality of milling balls to form a milled mixture; using induction heating to form a melt flow and induce electromagnetic forces; and initiating a plurality of stirring vortexes in the melt flow to form the metal matrix nanocomposite.

14 Claims, 6 Drawing Sheets

METHOD OF PREPARING A METAL MATRIX NANOCOMPOSITE

BACKGROUND OF THE INVENTION

1. Field of the Invention

The present invention relates to a method of synthesizing composite materials, and particularly, to the in-situ synthesis of metal-matrix nanocomposites utilizing electromagnetic forces, Lorentz forces to control the size and distribution level of ceramic reinforcements in the nanocomposites.

2. Description of the Related Art

Metal matrix composite materials (MMC) generally exhibit outstanding performance at elevated temperatures and have a high strength-to-weight ratio, which make these materials desirable for advanced applications in aerospace, automotive and marine industries. The size, morphology and the spatial distribution level of the reinforcement determine the final mechanical properties of the MMC. Recently, it has been found that metal matrix nanocomposites (MMNC) exhibit superior mechanical properties when compared to MMC. MMNC is a composite material including a metal matrix and ceramic reinforcements that are a few nanometers in size dispersed throughout the metal matrix. However, due to the nanometric size of ceramic reinforcements, the fabrication of MMNC is quite difficult because of the following challenges: (1) poor wettability between liquid metal and ceramic, (2) high clustering tendency of nano size particles, and (3) high oxidation affinity of liquid metal.

The fabrication of MMNC can be carried out by using in-situ synthesis or ex-situ synthesis techniques. In the in-situ synthesis technique, the reinforcement particles are obtained from a chemical reaction between two or more constituents of the material. However, in the ex-situ synthesis technique, the pre-manufactured reinforcements are added externally. A number of methods are presently recognized in the art of fabrication metal matrix nanocomposite materials. Many of these methods, however, fail to provide distribution homogeneity of the nano-sized reinforcements throughout the manufactured material.

Thus, a method of synthesizing metal matrix nanocomposites solving the aforementioned problems is desired.

SUMMARY OF THE INVENTION

A method for synthesizing a metal matrix nanocomposite (MMNC) is an in-situ synthesis technique for preparing a metal matrix with ceramic reinforcements dispersed homogenously therein. The method includes mixing a base metal matrix material with two or more ceramic-forming elements to form a mixture; blending the mixture; drying the mixture; ball milling the mixture with a plurality of milling balls to form a milled mixture; using induction heating to form a melt flow and induce electromagnetic forces; and initiating a plurality of stirring vortexes in the melt flow to form the metal matrix nanocomposite. The metal nanocomposite is in a homogenous phase.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
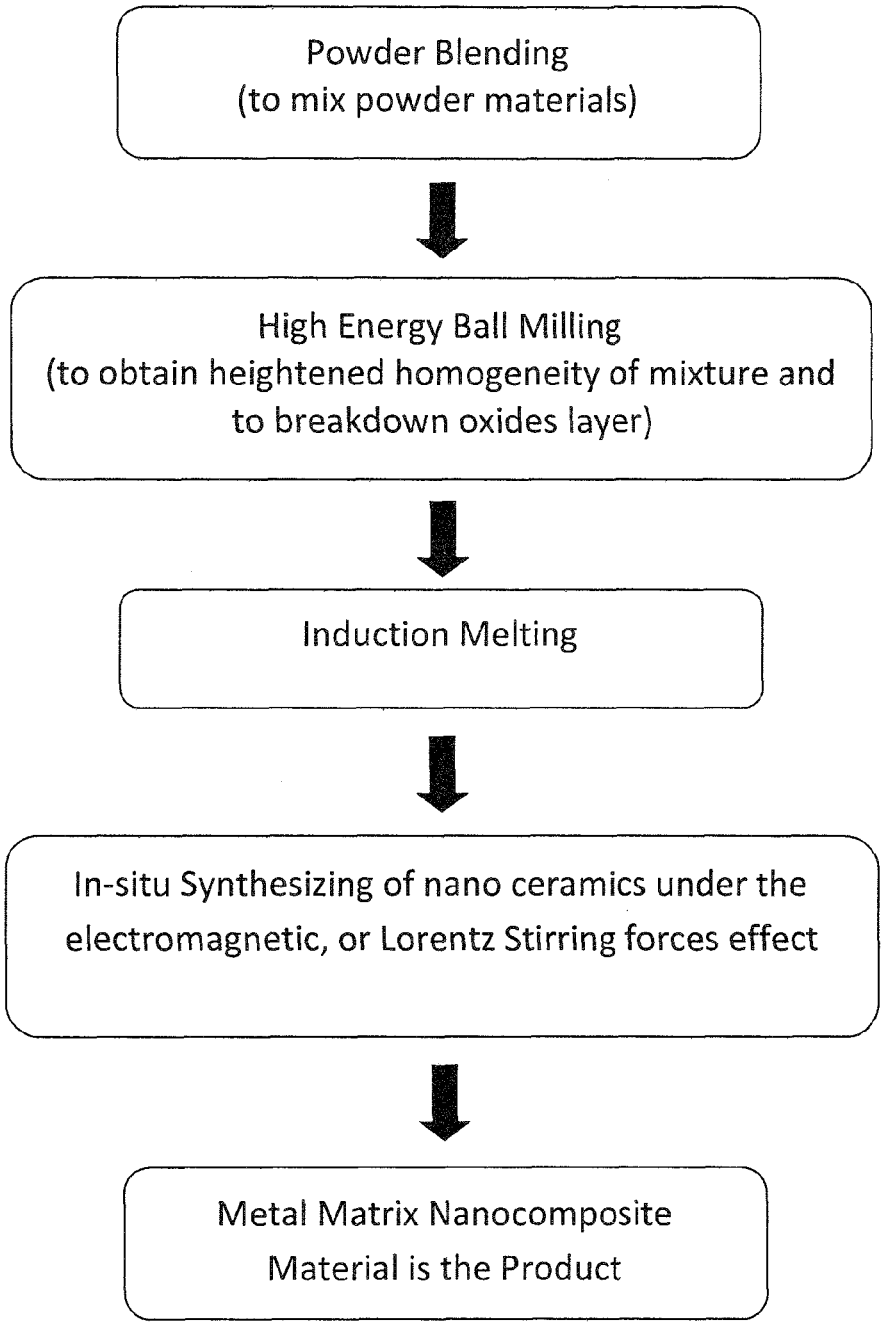
FIG. 1 is a flow chart of the fabrication process of the metal matrix nanocomposite according to the present inventive method.
Figure 2A:
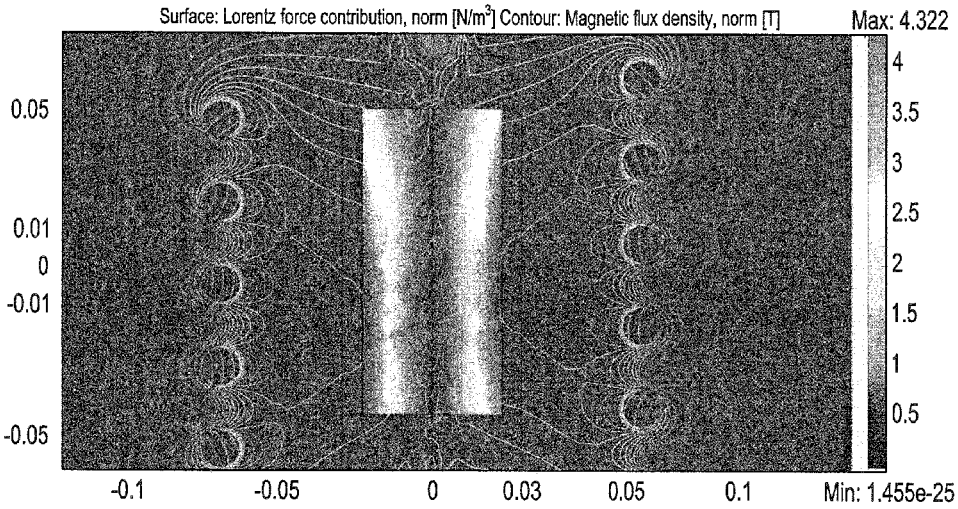
FIGS. 2A, 2B, 2C, and 2D show a simulation of the Lorentz forces generated at different frequencies (50 Hz, 150 Hz, 500 Hz, and 2000 Hz respectively).
Figure 2B:
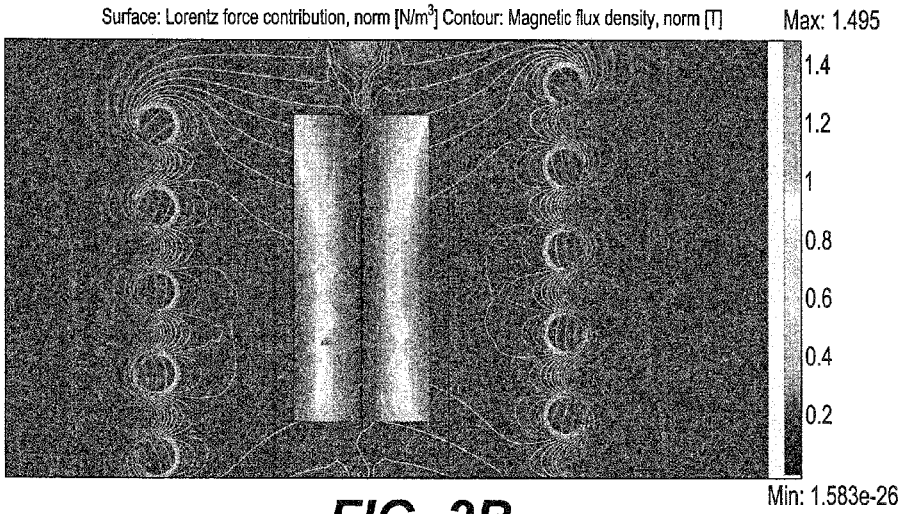
Figure 2C:
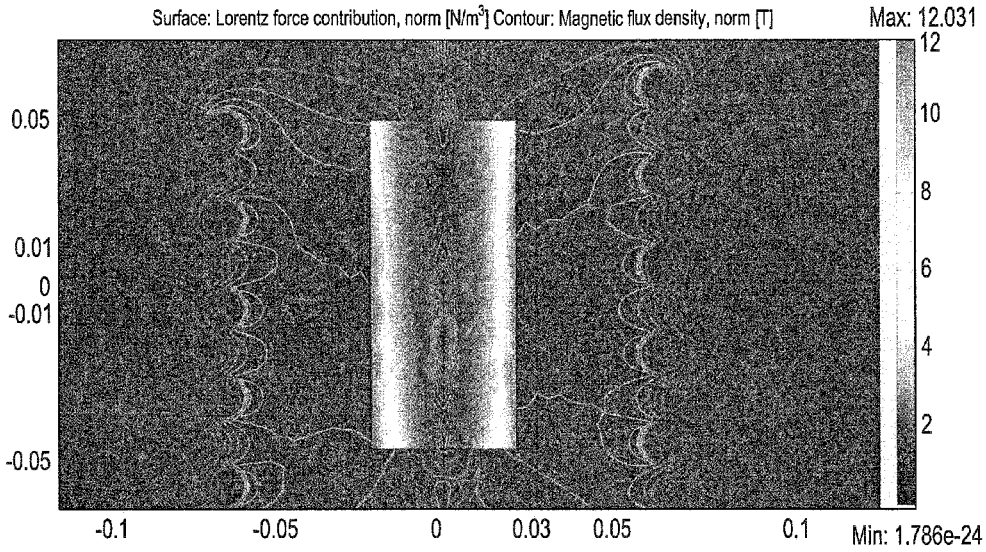
Figure 2D:
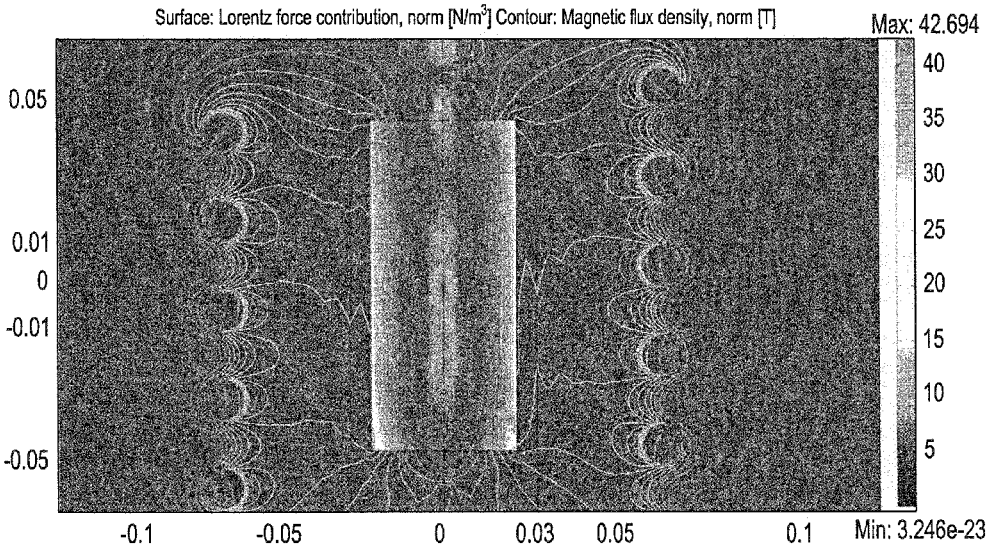

A method for synthesizing a metal matrix nanocomposite (MMNC) is an in-situ synthesis technique for preparing a metal matrix with ceramic reinforcements dispersed homogenously therein. The method includes mixing a base metal matrix material with two or more ceramic-forming elements to form a mixture; blending the mixture; drying the mixture; milling the mixture with a plurality of milling balls in a ball mill to form a milled mixture; using induction heating to form a melt flow and induce electromagnetic forces; and initiating a plurality of stirring vortexes in the melt flow to form the metal matrix nanocomposite. The metal nanocomposite is in a homogenous phase.

The mixture can be formed in a degassed organic solvent and blended under ultrasonic conditions at a temperature of, e.g., about 35° C. The organic solvent can be acetone. The mixing process can be carried out by dry mixing and/or wet mixing. In the dry mixing, the targeted materials are mixed using ultrasonic vibrator, mechanical stirrer, and/or barrel mixing with multi-axes movement. For wet mixing, the raw materials are mixed in a liquid bath of volatile solutions have no reaction affinity with the raw materials under ultrasonic stirring effects.

The mixture can be added to a ball-milling container, e.g., stainless steel or tungsten carbide jars, with stainless steel or tungsten carbide balls in a pre-determined ratio and rotated at high speed. The jar rotation can provide a mixture in the form of a granular composite. The ball milling can be performed at a rotation speed of at least 1000 rotations per minute for at least one hour in at least two different axes directions. The plurality of milling balls can include steel balls or tungsten carbide balls or mixtures thereof. The plurality of milling balls may include a first plurality of balls having a first size, a second plurality of balls having a second size, and a third plurality of balls having a third size. The first, second, and third sizes can be different from each other. The first size can be about 10 mm in diameter. The second size can be about 6 mm in diameter. The third size can be about 3 mm in diameter. The ball to mixture weight ratio in the ball mill container can be about 10:1. The milling balls and mixture can be held in a suitable milling container, e.g., a stainless steel jar with a capacity of about 80 ml.

The ceramic-forming elements can include at least two different elements having a high affinity to form a ceramic reinforcement compound. For example, the ceramic-forming elements can include at least two of the following elements: Ti, C, B, Zr, W, and Si. The ceramic-forming elements can react within the base metal matrix, e.g., liquid Al, to form the ceramic reinforcement. The base metal matrix can include Al, Mg, Zn, or Ti. The ceramic reinforcement can include at least one of TiC, $TiB_2$, ZrC, $ZrB_2$, WC, SiC, and $B_4C$. An exemplary weight percentage of Ti and C to form TiC particles can be about 1 wt % Ti and about 0.5 wt % C. This ratio is variable based on the base alloy, temperature, and required particle size. The ceramic reinforcements have nano-metric sizes and are synthesized in situ during the melting of the mixture using electromagnetic forces. The electromagnetic forces can include Lorentz forces. The electromagnetic forces can control the size and distribution level of the reinforcements.

In the melt processing stage, the milled mixture can be placed in a cylindrical crucible between two punchers made from electrical/thermal conductive material, such as graphite. The charge can be heated up to a targeted temperature range that is predetermined using thermodynamic calculations, and under the effect of the electromagnetic forces that are generated by the induction melting. The induced electromagnetic forces, Lorentz forces, drive the melt flow by initiating a number of micro stirring vortexes that affect the nucleation and growth kinetics of ceramic embryos within the melt. After a certain holding time at the aimed temperature, the charge is left to cool down under the continued effect of electromagnetic forces.

In-situ melting of the metal matrix nanocomposite can occur by induction heating using a commercially available high frequency induction melting unit to homogenize the metal matrix nanocomposite. The induction heating can generate an electromagnetic stirring force and/or Lorentz force. The melting can occur at temperatures ranging from about 1300° C. to about 1500° C. for a time period of about 3 minutes to about 6 minutes. The step of drying the mixture may occur at a temperature of about 50° C. under vacuum for about 12 hours to evaporate the organic solvent.

Figure 3:
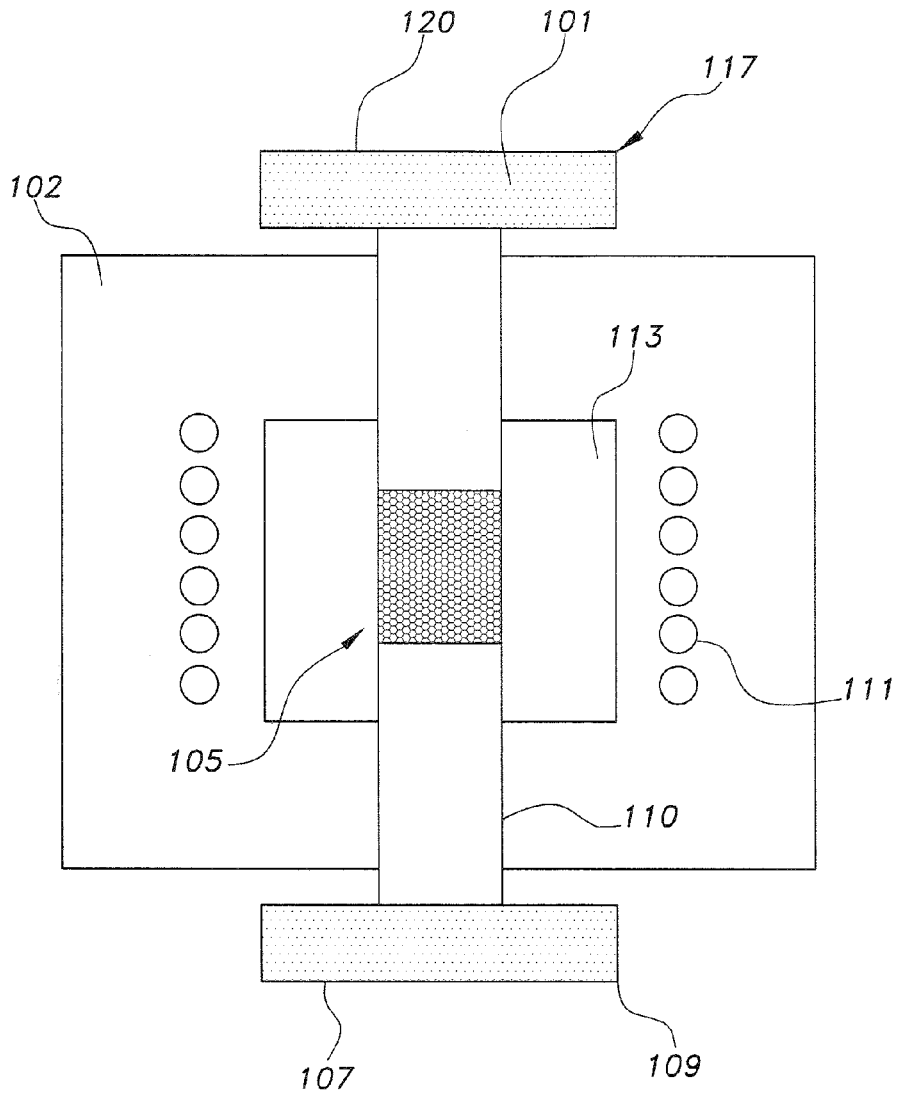
FIG. 3 depicts the configuration of the high-frequency induction heating unit (HFIH) unit.

Preferably, in the melt processing step, a high-frequency induction heating unit (HFIH) is utilized. The main configuration of the HFIH unit is shown in FIG. 3. The HFIH unit includes an induction coil 111, a uniaxial pressure device 101 and a graphite die 113 with the following dimensions of 20 mm internal diameter, 45 mm external diameter, and 40 mm height, respectively. The sample 105 is placed inside the graphite die 113 in between the upper punch 117 and the lower punch 110. The unit is also equipped with a water-cooled reaction chamber, which can be evacuated, induced current, and pressure, position- and temperature regulating systems. The milled mixture is placed in a graphite die 113 between two graphite punchers 110 and 117, and then the assembly is situated at the core of a high-frequency induction coil 111 at the heating focal point. The induction melting begins by passing an alternative current through the copper coil creating a strong magnetic field around the coil and cutting the graphite assembly. The magnetic field in turn creates an induced current flow throughout the assembly that is heated up to the required melting temperature. The interaction between the induced current and magnetic wave generates the electromagnetic stirring forces, Lorentz forces that control the flow pattern of the melt stirring according to Faraday's law and right hand rule.

Nanocomposite refers to a multiphase solid material where one of the phases has one, two or three dimensions of less than 100 nanometers (nm), or structures having nanoscale repeat distances between the different phases that make up the material. As used herein the term "nanoparticle" refers to a particle having at least one dimension sized between 1 and 100 nanometers. As used herein the term, Lorentz force is the electromagnetic stirring force that forms due to the interaction between the induced current and magnetic wave during the induction melting, and is the driving force for the liquid metal stirring in producing the in-situ synthesized nano-metal matrix composite. The term base metal is intended to mean the individual metal matrix of the composite such as Al, Mg, or Zn in which the ceramic compound can form. For example, Zr and C can be added to Al matrix (liquid Al) to form ZrC inside the Al matrix (the base metal), or Zr and C can be added to Mg matrix (liquid Mg) to form ZrC inside the Mg matrix (the base metal).

FIG. 1 is a flow chart of the fabrication process of the metal matrix nanocomposite according to the present inventive method. Preparation of the metal matrix nanocomposite materials by in-situ synthesis requires a high degree of purity of the constituent materials, and avoiding impurities that may inhibit the in-situ reaction. The oxidation activity is preferably kept as low as possible in order to optimize the wetting and full incorporation of in-situ synthesized nanoceramic particles by the liquid metal (Al, Mg, Zn, Ti, etc.). It should be noted that the fabrication method described herein is applicable for both ferrous and non-ferrous metal matrix materials. However, the aluminum metal matrix will be used as the main example herein to illustrate manufacturing details of the inventive method.

Pure aluminum and aluminum alloy powder can be prepared by atomization, melt spinning, plasma method, or splat quenching. Preferably, atomization is preferred. In atomization, aluminum droplets are broken down and rapidly solidified into fine particles with an average size range of a few nanometers to a few millimeters. In the present method, pure aluminum and aluminum alloys are used in the form of fine powder or in granular form. These powders or granular particles are then mixed by the targeted elements that can form ceramic compounds at elevated melting temperatures.

The in-situ synthesis of metal matrix nanocomposite materials by melt processing has previously been difficult due to (i) uncontrollable size of the produced reinforcements, (ii) severe agglomeration of the reinforcement particles because of capillary and Van Der Waals attractive forces, (iii) high oxidation affinity of the metals, and (iv) in some cases poor wettability between the reinforced ceramics and the melt. In the inventive method, however, metal matrix nanocomposite materials have been in-situ synthesized under the effects of electromagnetic forces to overcome the abovementioned drawbacks.

Electromagnetic forces are utilized to reach a heightened homogeneity of the melt at which maximized embryos density of ceramic reinforcements is achieved under restricted growth condition. Due to an interaction between the induced current and electromagnetic waves in the melt, powerful forces called the electromagnetic forces, Lorentz forces, are formed. These forces result in intense and localized stirring forces that determine the melt flow pattern. The Lorentz force is able to minimize the Ostwald ripening phenomenon by equalizing the solutes concentration at the surfaces of the formed ceramic particles in the melt, resulting in a significant reduction in their growth and coarsening tendency. The localized stirring effect of Lorentz force results in intensive shearing forces that can break down the particles agglomeration and decrease the clustering tendency. As a result of the intensive and localized stirring effect of the Lorentz forces, any oxide layer formed on the particle surfaces wash out, providing an intimate and clean ceramic/liquid metal interface. This results in the optimized incorporation of ceramic reinforcements within the melt. The intensity of the Lorentz force is controlled by frequency adjustments. FIGS. 2A-2D show the simulated effect of frequency level on the intensity and distribution profile of the Lorentz force throughout the melt. The melt stirring flow is changed according to the Lorentz force distribution profile which in turn depends on the conducted frequency level.

The following examples will further illustrate the synthetic processes of making metal matrix nanocomposite.

Example 1

Mixing of the Nanocomposite Precursor

Pre-designated masses of Al-6% Ti alloy and graphite powders providing the stoichiometric ratio of titanium carbide ceramic compound were mixed in acetone solution and stirred by using an ultrasonic bath. In the beginning of the stirring process, the mixture was degassed for about 2 hours to remove any entrapped gases and moisture among the particles. In the next 2 hours, the mixture was vigorously stirred in the acetone solution which was preheated to 35° C. This stirring technique optimized the distribution homogeneity of the constituent materials with lesser oxidation possibility. After stirring, the mixture was placed in an oven at 50° C. under vacuum for 12 hours to evaporate acetone. The mixture was kept under vacuum until the second step was performed.

Example 2

High Energy Ball Milling of the Metal and Graphite Mixture

In the second step, the dried mixture of Al-6% Ti/graphite obtained from the ultrasonic bath mixing in Example 1 was combined with stainless steel balls that were 10 mm, 6 mm, and 3 mm in size. The balls were added to the mixture in a weight ratio of 10/1 (balls/mixture). The ball milling technique was used to prevent clustering tendency between powders due to the Van Der Waals attractive forces, and the formation of oxide layers on the metals. The presence of an oxide layer at metal surface can have negative effects on the in-situ synthesis reactions of the ceramic compounds during the melt processing. In addition, the chemical reactivity can be halted due to the presence of the oxides that prevent an intimate contact among the reactant elements. Further, during the melt stirring process, the oxide films may trap the formed ceramic particles within the melt causing full rejection and poor incorporation of those intermetallic compounds.

The charge was added to a stainless steel jar with 80 ml capacity and rotated at 1000 rpm for about 1 hour in two different axes directions, creating an intensive vibration in a conventional high energy ball mill, e.g., planetary ball mill. After the milling process, the jar was left to cool down to ambient temperatures, and then the milled mixture is removed and kept under vacuum to avoid oxidations until the next step.

Example 3

Melt Processing Using a High Frequency Induction Heating Unit

The ball milled mixture of Al-6% Ti/graphite was added to the graphite die that is placed in the core of the induction coil at the heating focal point and under applied pressure of 3 MPa. High vacuum was applied on the melting chamber to avoid oxidation and to remove the trapped gases and moistures. Due to the generation of the induced current passing through the assembly, the temperature continued to increase until it reaches the targeted melting temperature. The targeted temperature was decided based on the calculation of the standard Gibbs free energies of TiC formation. In liquid state, the titanium and carbon were considered as diluted solutes in liquid aluminum solution and thus the targeted temperature was defined as the temperature at which the formation reaction of TiC is maximized at the expense of the other reactions. Accordingly, the targeted temperature of TiC in-situ synthesized is determined by calculating the standard Gibbs free energies (ΔG) of the following possible reactions:

$$\mathrm{Ti(1.0\ wt\ \%)+C(s)=TiC(s)} \tag{1}$$

$$\Delta G(J\mathrm{mol}^{-1}) = -91951 + 34.377T + 0.460\times10^{-3}T^2 + \frac{3.096\times10^5}{T} - 0.962T\ \ln T \tag{2}$$

$$4/3\mathrm{Al(l)+C(s)=1/3Al_4C_3(s)} \tag{3}$$

$$\Delta G(\mathrm{Jmol}^{-1})=-89.611+32.841\mathrm{T} \tag{4}$$

$$\mathrm{Ti(l)+3Al(l)=Al_3Ti(s)} \tag{5}$$

$$\Delta G(\mathrm{Jmol}^{-1})=-52503+21.483\mathrm{T} \tag{6}$$

Figure 4:
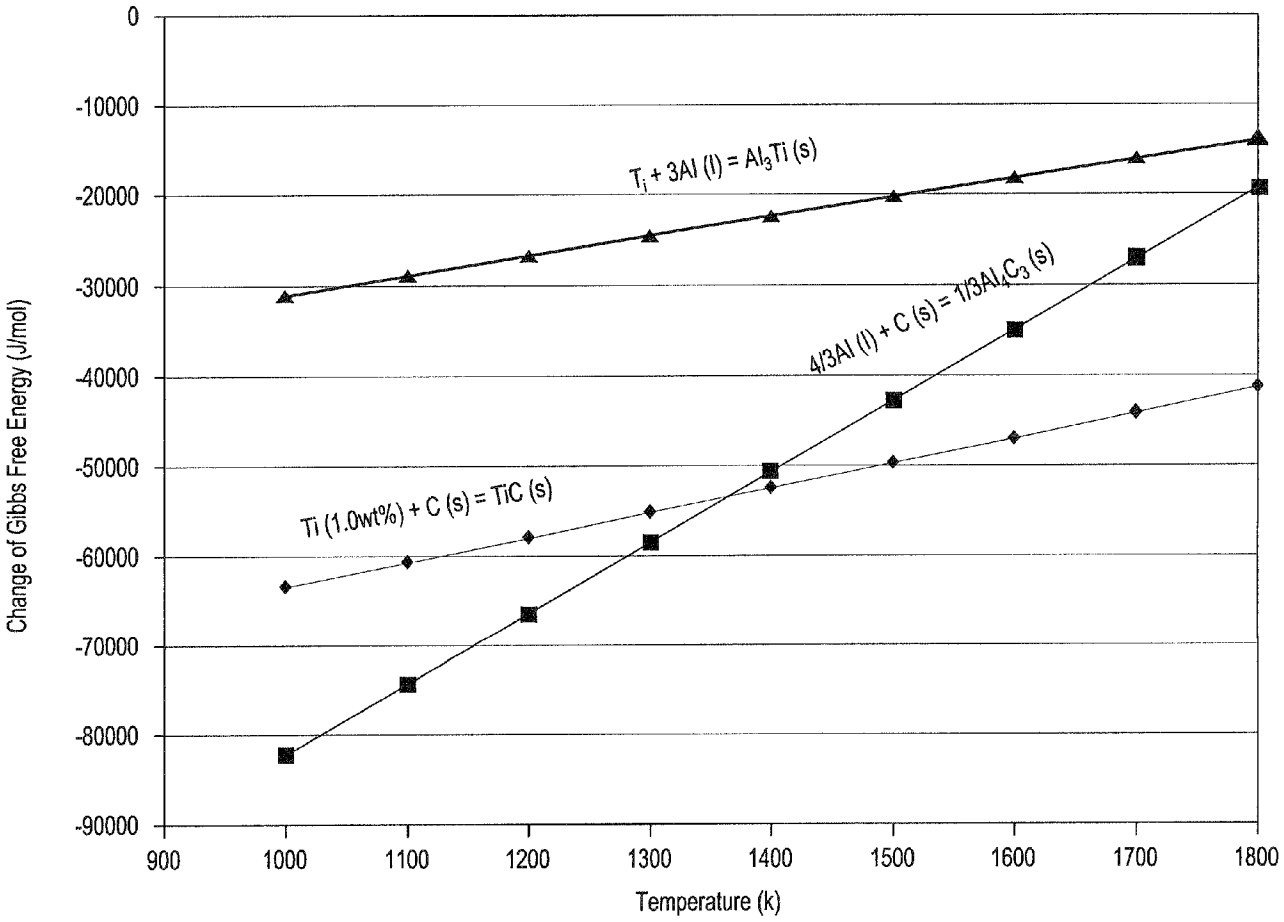
FIG. 4 is a graph showing the calculated curves of the standard Gibbs free energies of TiC formation reactions.
Figure 5A:
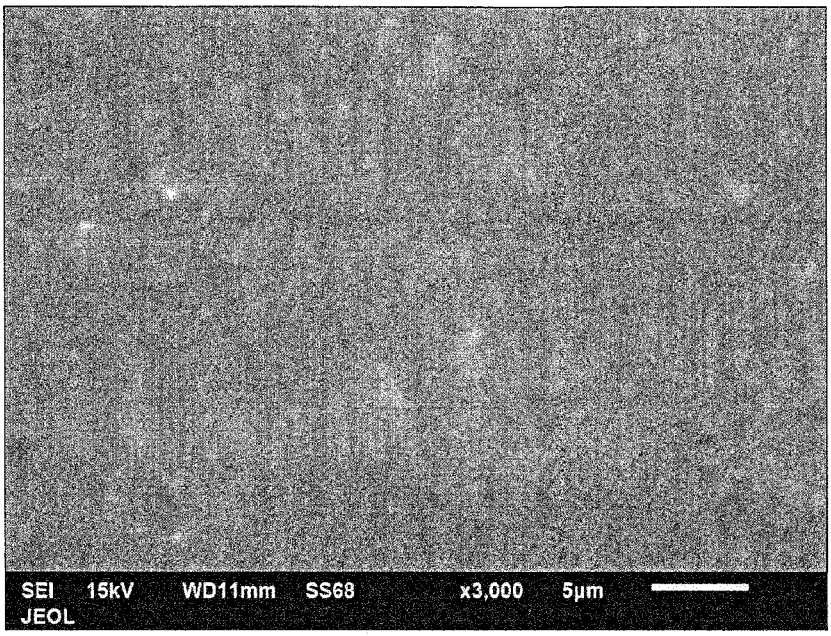
FIGS. 5A and 5B show the microstructure of the manufactured Al—TiC nanocomposite materials at different magnifications.
Figure 5B:
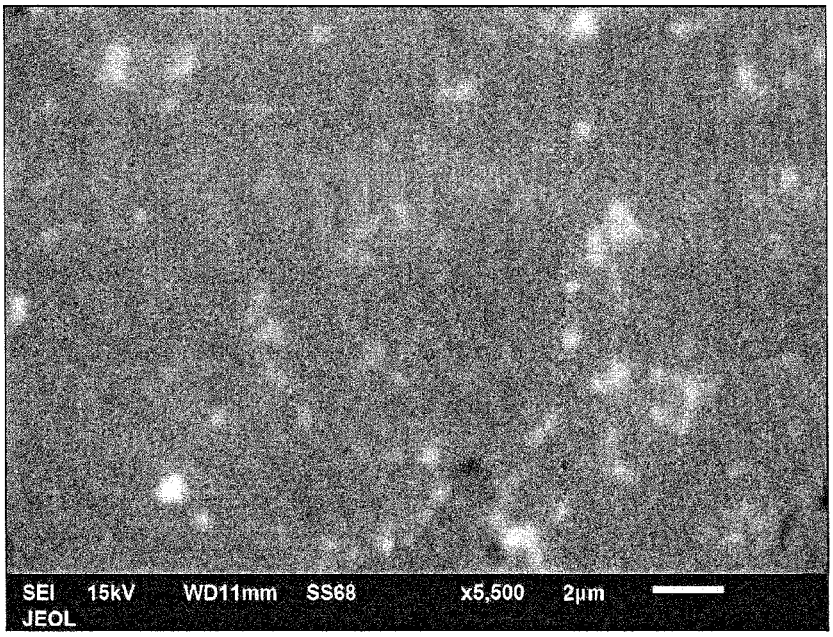

FIG. 4 shows the calculated curves of the standard Gibbs free energies of TiC formation reactions. From FIG. 4, it can be seen that the best melt processing temperature should be higher than 1350K (1100° C.) in order to increase the stability of the formation reaction of TiC and to minimize the formation of unfavorable $Al_4C_3$ compound which be unstable above this temperature. Thus, the melting temperature range was selected to be 1300° C.-1500° C. for an elapsed time range of 3 min to 6 min. Melting was recognized as the aluminum melt came out of the graphite die at the top. As melt processing was completed, the slurry of liquid aluminum containing the nano TiC ceramics was left to solidify under the stirring effect of the electromagnetic forces. The microstructures of the prepared composite revealed the formation of nano TiC particles throughout the aluminum matrix in high spatial distribution, providing outstanding levels of mechanical properties, as illustrated in FIG. 5.

The melt processing technique as described can be used for in-situ synthesis of the nano metal matrix composite (NMMC), which includes various ceramic compounds such as TiC, WC, $TiB_2$, ZrC, SiC, $B_4C$, etc. The in-situ synthesized nano-metal matrix composite (NMMC) was characterized by superior thermal stability, mechanical properties and corrosion resistance. The NMMC materials fabricated by the present technique can be used in advanced aerospace, automotive, and marine applications that require materials with high thermal stability. These applications include pistons, cylinder heads, turbines, engines, aircraft parts, and submarine parts.

It is to be understood that the present invention is not limited to the embodiments described above, but encompasses any and all embodiments within the scope of the following claims.

We claim:

1. An in-situ method for synthesizing a metal matrix nanocomposite with ceramic reinforcements dispersed homogeneously therein, the method consisting of:

mixing a base metal matrix material with two or more distinct ceramic-forming elements in a degassed organic solvent to form a mixture;

blending the mixture, wherein the mixture is blended under ultrasonic conditions at a temperature of about 35° C.;

drying the mixture to remove the organic solvent;

ball-milling the mixture in a ball milling container using a plurality of milling balls to form a milled mixture;

using induction heating to form a melt flow from the milled mixture and to induce electromagnetic forces; and initiating a plurality of stirring vortexes in the melt flow to produce the ceramic reinforcements in situ to form the metal matrix nanocomposite, wherein the stirring is initiated by electromagnetic forces induced by the induction heating.

2. The method for synthesizing a metal matrix nanocomposite according to claim 1, wherein the electromagnetic forces include Lorentz forces.

3. The method for synthesizing a metal matrix nanocomposite according to claim 1, wherein the step of drying the mixture occurs at a temperature of about 50° C. under vacuum for about 12 hours to evaporate the organic solvent.

4. The method of synthesizing a metal matrix nanocomposite according to claim 1, wherein melting of the mixture occurs at temperatures ranging from about 1300° C. to 1500° C., for a time period of about three minutes to about six minutes.

5. The method of synthesizing metal matrix nanocomposite according to claim 1, wherein the organic solvent is acetone.

6. The method of synthesizing metal matrix nanocomposite according to claim 1, wherein the base metal matrix is selected from the group consisting of Al, Mg and Zn.

7. The method of synthesizing metal matrix nanocomposite materials according to claim 1, wherein the two or more ceramic-forming elements are selected from the group consisting of C, Zr, B, W, Si, Ti, and combinations thereof.

8. The method of synthesizing a metal matrix nanocomposite according to claim 1, wherein the ceramic-forming elements react within the base metal in-situ to form a ceramic reinforcement compound comprising at least one of TiC, $TiB_2$, ZrC, $ZrB_2$, WC, SiC, and $B_4C$.

9. The method of synthesizing metal matrix nanocomposite according to claim 1, wherein the plurality of milling balls include at least one of steel balls and tungsten carbide balls.

10. The method of synthesizing a metal matrix nanocomposite according to claim 1, wherein the ball milling is operated at a rotation speed of at least 1000 rotations per minute for at least one hour in at least two different axes directions.

11. The method of synthesizing a metal matrix nanocomposite according to claim 1, wherein the plurality of milling balls include a first plurality of balls having a first size, a second plurality of balls having a second size, and a third plurality of balls having a third size, the first size, second and third sizes being different.

12. The method of synthesizing metal matrix nanocomposite according to claim 11, wherein the first plurality of balls are about 10 mm in diameter, the second plurality of balls are about 6 mm in diameter, and the third plurality of balls are 3 mm in diameter.

13. The method of synthesizing a metal matrix nanocomposite according to claim 1, wherein the ball milling container includes a stainless steel jar with a capacity of about 80 ml.

14. The method of synthesizing a metal matrix nanocomposite according to claim 1, wherein a ball to mixture weight ratio in the ball milling container is about 10:1.

* * * * *